US005128717A

United States Patent [19]

Uchikawa et al.

[11] Patent Number: 5,128,717

[45] Date of Patent: Jul. 7, 1992

[54] IMAGE FORMING APPARATUS

[75] Inventors: Yoshio Uchikawa, Yokohama; Atsushi Takeda, Kawasaki, both of Japan

[73] Assignee: Canon Kabushiki Kaisha, Tokyo, Japan

[21] Appl. No.: 574,044

[22] Filed: Aug. 29, 1990

[30] Foreign Application Priority Data

Aug. 31, 1989 [JP] Japan ..... 1-226320

[51] Int. Cl.[5] ..... G03G 15/01; G03G 15/14

[52] U.S. Cl. ..... 355/208; 355/271; 355/274; 355/219; 355/327

[58] Field of Search ..... 355/208, 271, 274, 275, 355/217, 276, 219, 221, 326, 327

[56] References Cited

U.S. PATENT DOCUMENTS 4,676,627 6/1987 Ohno .
4,860,048 8/1989 Itoh et al. ..... 355/208
4,888,618 12/1989 Ishikawa ..... 355/208
4,912,515 3/1990 Amemiya et al. ..... 355/274
4,941,003 7/1990 Takeda et al. ..... 346/160

*Primary Examiner*—R. L. Moses
*Attorney, Agent, or Firm*—Fitzpatrick, Cella, Harper & Scinto

[57] ABSTRACT

An image forming apparatus includes a movable image bearing member; an image forming device for forming an image on the image bearing member; transfer charging device for transferring an image from the image bearing member onto an image receiving material at an image transfer position; a detector for detecting an ambient condition of the apparatus; a controller for controlling an output of the transfer charging device in accordance with an output of the detector, wherein the output of the transfer charging device is a function of the output of the detector; and a correcting device for correcting the function.

57 Claims, 7 Drawing Sheets

IMAGE FORMING APPARATUS

FIELD OF THE INVENTION AND RELATED ART

The present invention relates to an image forming apparatus such as a copying machine or a laser beam printer in which an image receiving material such as transfer sheet of paper is contacted to an image bearing member having thereon a toner image, and the image is transferred to the image receiving material from the image bearing member by discharging means such as corona charger.

Referring first to FIG. 5, there is shown an example of such an image forming apparatus in the form of a full-color copying machine. In the apparatus, an image bearing member in the form of a photosensitive drum 101 is rotated in a direction a and is uniformly charged by a primary charger 102, and then is exposed to image light 103 in accordance with image information by exposure means including a laser beam exposure means or the like, so that an electrostatic latent image is formed on the photosensitive drum 101. The electrostatic latent image is developed by a movable developing device 104 into a visualized toner image.

The movable developing device 104 is provided with four developing device 104M, 104C, 104Y and 104B containing magenta developer, cyan developer, yellow developer and black developer, respectively. The movable developing device 104 includes a guide member (not shown) movable in a horizontal plane, so that a desired one of the developing devices is brought to a developing position where the selected developing device is faced to an outer periphery of the photosensitive drum 1 to develop the electrostatic latent image.

On the other hand, the image receiving material in the form of a transfer sheets P is supplied in synchronism with image formation to a transfer material supporting member 107 functioning as the image receiving material supporting member rotatable in a direction b and including a dielectric sheet 107*a*. In the space enclosed by the transfer material supporting member 107, there is an attraction charger 108 for effecting corona discharge to supply electric charge to the back surface of the dielectric sheet 107*a*. The attraction charger 108 and a grounded conductive roller 109 functioning as the opposite electrode, constitute attraction means 110. The transfer material P is electrostatically attracted on the transfer material supporting member 107, by the attraction means 110. In the sheet attraction station, there is a transfer sheet urging member 111*a* to confine the corona discharge of the attraction charger 108 and to form a nip between the dielectric sheet 107*a* and the conductive roller 109. The sheet urging member 111*a* is usually made of insulating material, and it may be of elastic material in order to provide a large nip.

The transfer material P attracted on the transfer material supporting member 107 is conveyed to an image transfer zone A where the toner image is transferred from the photosensitive drum 101 by a transfer charger 112 disposed inside the transfer material supporting member 107. At this time, electric charge having a polarity opposite to that of the toner is applied by the transfer charger 112 onto the back surface of the dielectric sheet 107*a*. Similarly to the attracting station, the image transfer station is provided with a transfer sheet urging member 111*b* to confine the corona discharge of the transfer charger 112 and to form a nip between the dielectric sheet 107*a* and the photosensitive drum 101.

After the transfer material P receives four different color toner images from the photosensitive drum 1 by four rotations of the transfer material supporting member 107, it is brought to a separation zone B, where it is separated from the transfer material carrying member 107 by a separation pawl 113. At this time, the backside of the dielectric sheet 107*a* and the front side (toner image charging side) of the transfer material P are electrically discharged by an inside discharger 114 and an outside discharger 115 disposed at the opposite sides of the dielectric sheet 107*a* and by a separation charger 116 disposed downstream thereof in a direction b. The dischargers are usually supplied with AC voltages, although they may be supplied with DC biased AC voltages in order to enhance the discharging efficiency.

The transfer material P separated from the transfer material supporting member 107 is discharged to the outside after the toner image is fixed by an unshown fixing device. On the other hand, the photosensitive drum 101 and the transfer material supporting member 107 are cleaned by cleaners 117 and 118, respectively to be prepared for the next image forming operation.

The attraction charger 108, the transfer charger 112, the inside charger 114, the outside charger 115 and the separation charger 116 are supplied with high voltages from high voltage sources 120, 121, 122, 123 and 124. The output current or voltage of the high voltage sources 120–24 is controlled by a high voltage control means 125.

In a conventional full-color copying apparatus having the above-described structures is provided with temperature and humidity sensors, as disclosed in U.S. Pat. No. 4,912,515. On the basis of the results of detection, the outputs of the transfer charger and the discharger disposed downstream thereof are controlled. In this U.S. Patent, plural zones are prepared which are defined by plural constant water amount curves determined by the temperature and humidity, and the discrimination is made as to in which zone the outputs of the temperature and humidity sensors fall. On the basis of the discrimination, the transfer current by the transfer charger and the discharging current by the discharger are controlled. The U.S. Patent proposes that in consideration of the fact that the temperature and humidity detected in the apparatus are not necessarily equal to the temperature and humidity outside the apparatus where the transfer sheets are accommodated, the zones defined by the constant water amount curves are corrected.

However, in the prior art apparatus, the properties of the individual machines, namely the variations in the properties of the individual machines are not taken into account, with the result of the following problems:

(1) If the total impedances of the individual machines adjacent to the dischargers are very different, the amount of electric charge received by the dielectric sheets during the transfer operations by the respective dischargers are different even if the same electric currents are set. Therefore, the optimum electric currents are different for individual dischargers, and it has been difficult to meet the difference in the prior art: and (2) Even in one and the same discharger, the discharge distribution in the neighborhood of the discharger changes with use, so that the amount of electric charge contributable to the image transfer action becomes different even if the same electric current is set;

and therefore, the optimum electric current in a discharger changes with time; and it has been difficult to meet the change.

Particularly when the confining member such as the transfer sheet urging member effective to confine the corona discharge is made of elastic material contacted to the dielectric sheet, the change in the impedance is remarkable due to the deterioration of the regulating member with use, so that the above described tendency of the problems is enhanced.

Because of this unstabilized amount of electric charge provided by the discharger during the transfer action, an improper image transfer such as local transfer void occurs with the result of the degraded image quality.

SUMMARY OF THE INVENTION

Accordingly, it is a principal object of the present invention to provide an image forming apparatus wherein the amount of electric charge supplied by the transfer charging means during the transfer operation is maintained at the optimum level so that good image transfer operation can be performed to provide high quality images.

It is another object of the present invention to provide an image forming apparatus wherein the amount of electric charge by the discharging means applied to the image receiving material carrying means is maintained at the optimum level to enable a high quality image to be formed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
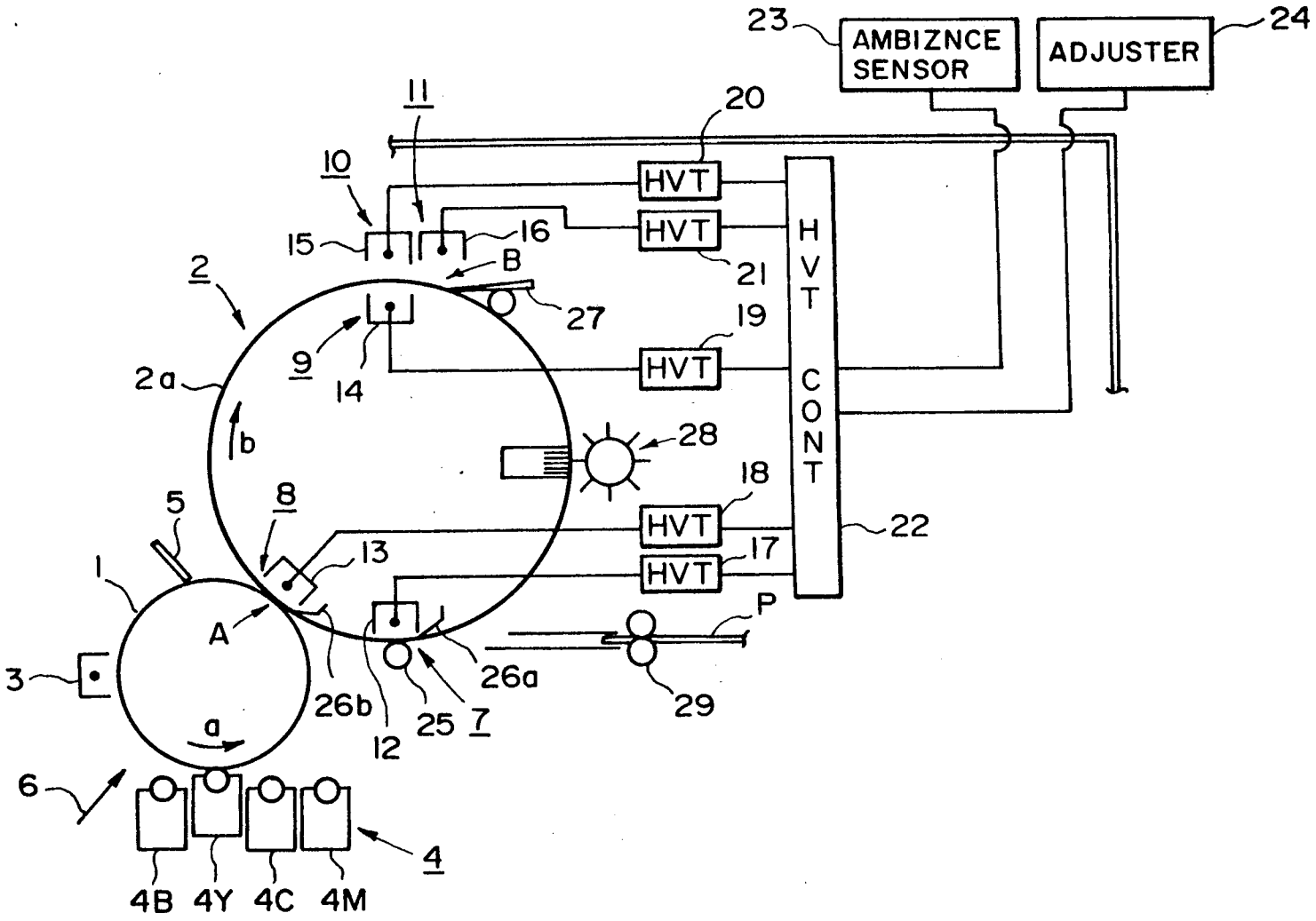
FIG. 1 is a sectional view of a part of an image forming apparatus according to an embodiment of the present invention.

Referring to FIG. 1, there is shown a part of an image forming apparatus according to an embodiment of the present invention. The image forming apparatus is a full-color copying machine, and is provided, similarly to the conventional apparatus, with a photosensitive drum 1 as the image bearing member rotatable in a direction a. Similarly, there is disposed a transfer material carrying member (image receiving material carrying member) 2 having a surface made of a dielectric sheet 2*a*, which is rotatable in a direction b.

Around the photosensitive drum 1, there are a primary charger 3, developing means 4 having developing devices 4M, 4C, 4Y and 4B, and a cleaner 5.

The photosensitive drum 1 is uniformly charged by the primary charger 3 and exposed to light image 103 in accordance with image information by exposure means including a laser beam exposure device or the like, so that an electrostatic latent image is formed. The latent image is developed by the developing device 4M containing the magenta developer into a magenta toner image.

On the other hand, inside or around the transfer material carrying member 2, there are attraction charging means 7, transfer charging means 8, inside discharging means 9, outside discharging means and a separation charging means 11 in the form of discharging means.

The attraction charging means 7, the transfer charging means 8, the inside discharging means 9, the outside discharging means 10 and the separation charging means 11 are provided with an attraction charger 12, a transfer charger 13, an inside charger 14, an outside charger 15 and a separation charger 16 in the form of dischargers. The attraction charger 12, the transfer charger 13, the inside charger 14, the outside discharger 15 and the separation charger 16 are supplied with high voltages from high voltage sources 17, 18, 19, 20 and 21, respectively. The high voltage sources 17–21 are electrically coupled with high voltage control means 22.

As shown in the Figure, the apparatus is provided with a conductive roller 25, sheet urging means 26*a* and 26*b*, a separation pawl 27, a cleaner 28 and a registration roller 29.

The image receiving material is in the form of an image transfer sheet of paper contained in an unshown cassette which is outside the image forming apparatus. The transfer sheet is supplied by a registration roller 29 to the transfer material carrying member 2 having a dielectric sheet 2*a* and rotatable in the direction b. Inside the transfer material carrying member 2, the attraction charger 12 is located, which is supplied with a DC voltage to effect corona discharge for applying electric charge to the backside of the dielectric sheet 2*a*. It constitutes attraction means together with a grounded conductive roller 25 functioning as the opposite electrode for the attraction charger. The transfer material P is electrostatically attracted on the dielectric sheet 2*a* of the transfer material carrying member by the attraction means 7. The attraction station is provided with a sheet urging member 26*a* for urging the backside of the dielectric sheet to confine the corona discharge of the attraction charger 12 and to form a nip between the dielectric sheet 2*a* and the conductive roller 25. The sheet urging member 26*a* is usually made of insulating material, and further, it may be of elastic material in order to provide the larger nip (contact) area.

The transfer material P supported on the transfer material carrying member 2 is brought to an image transfer position A where the transfer charger 13 is faced to the photosensitive drum 1, in such a timed relation that the leading edge of the transfer material P is in alignment with the leading edge of the magenta toner image on the photosensitive drum 1. At the transfer position A, the magenta toner image is transferred from the photosensitive drum 1 onto the transfer material P by a transfer corona charger 13 located inside the transfer material carrying member 2. At this time, electric charge having the polarity opposite to that of the toner is applied to the backside of the dielectric sheet 2*a* by the transfer charger 13 which is supplied with a DC voltage. Similarly to the attraction station described in the foregoing, the image transfer station is provided with a sheet urging member 26b to confine the corona discharge of the transfer charger 13 and to form a nip (contact) between the dielectric sheet 2a and the photosensitive drum 1.

After the image transfer operation, the photosensitive drum 1 is cleaned by a cleaner 5 so that the residual toner is removed therefrom. Then, a cyan toner image is formed through the similar steps as described above but with the use of the developing device 4c. The transfer material P carried on the transfer material carrying member 2 and the dielectric sheet 2a, after the image transfer, are electrically discharged by a pair of corona dischargers (the inside discharger 14 and the outside discharger 15) disposed downstream of the transfer charger 13 with respect to the movement direction of the transfer material carrying member 2. The dischargers 14 and 15 are usually supplied with an AC voltage, but it may be supplied with a DC biased AC voltage in order to enhance the discharging efficiency.

Onto the transfer material P having the magenta toner image and carried on the transfer material carrying member 2, the cyan toner image is superposedly transferred from the photosensitive drum 1 at the transfer position A. Thereafter, in the similar manner, the transfer material P is discharged by the pair of dischargers 14 and 15.

The similar operation is repeated using the developing device 4Y containing the yellow developer and the developing device 4B containing the black developer. Thus, the transfer material carrying member 2 rotates 4 turns in total, so that the transfer material P receives four color toner images from the photosensitive drum 1. The transfer material P is then brought to a separating station B where it is separated from the transfer material carrying member 2 by separation pawls 27. At this time, the dielectric sheet 2a and the surface of the transfer material P (the toner image carrying surface) are electrically discharged by a separation charger 16 to which an AC voltage is applied.

The transfer material P separated from the transfer material carrying member 2 is conveyed to an unshown fixing device where the four color toner images are mixed and fixed. Then, it is discharged to the outside of the apparatus. On the other hand, the photosensitive drum 1 and the transfer material carrying member 2 are cleaned by the cleaner 5 and the cleaner 28, respectively so as to be prepared for the next image formation.

The high voltage control means 22 is electrically coupled with ambience sensor means 23 (temperature and humidity sensor means) for detecting absolute water content in the ambience in the apparatus, and on the basis of the information from the ambience sensor means 23, the output currents or the output voltage of the individual chargers and dischargers are controlled. By doing so, the chargers and dischargers are operated to effect discharge with the proper currents for the respective chargers in accordance with the ambient conditions, so that proper amount of electric charge is applied to the dielectric sheet 2a or the like.

Figure 6:
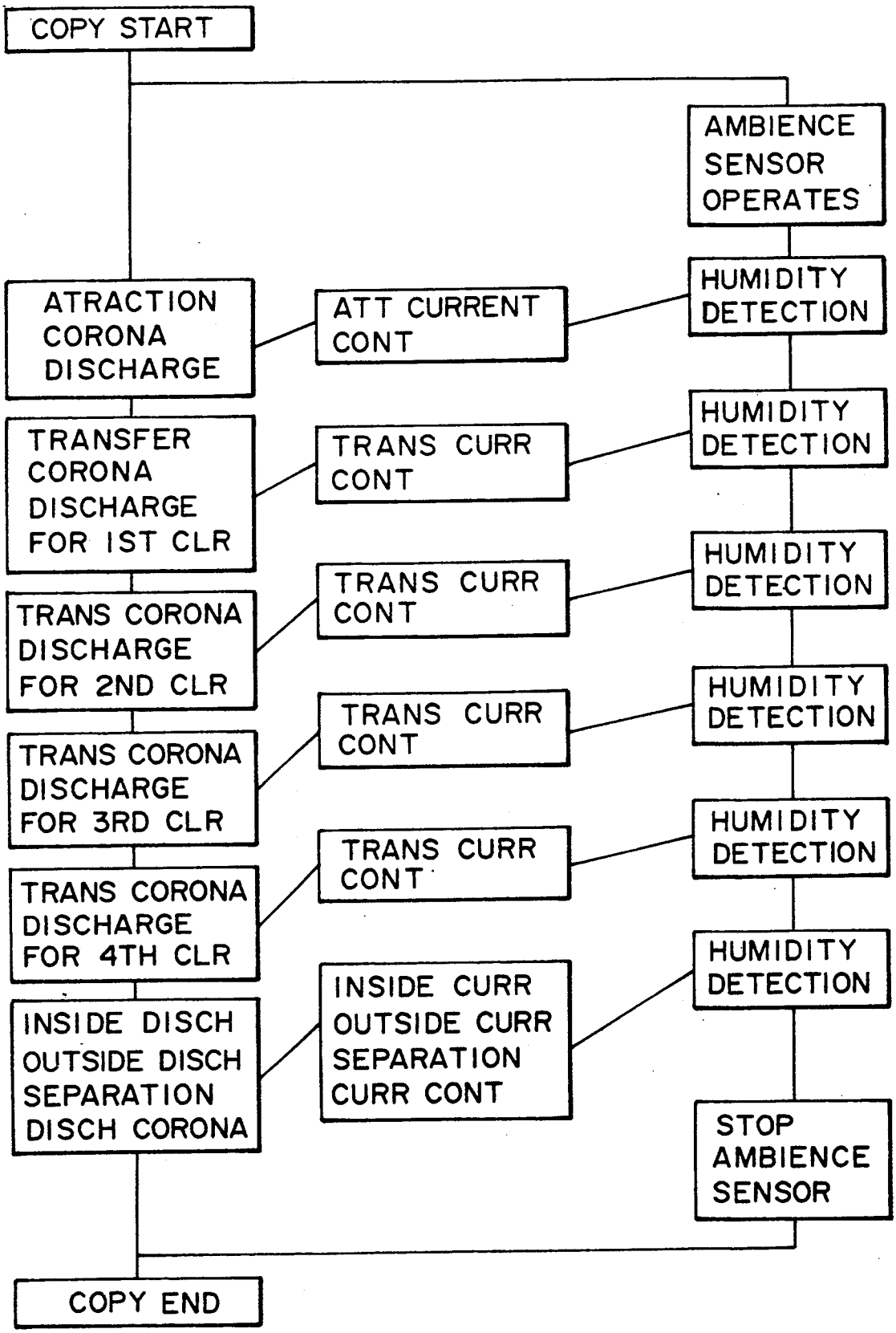
FIG. 6 is a flow chart illustrating the control of the output current of a high voltage source in an image forming apparatus according to the present invention.
Figure 7A:
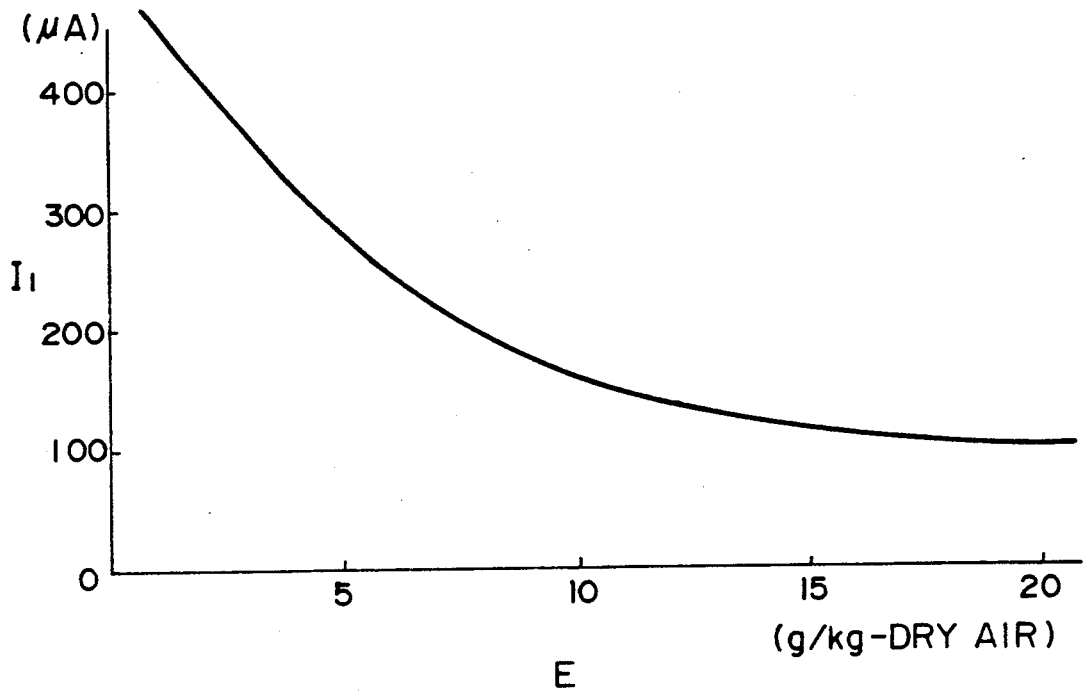
FIGS. 7A, 7B and 7C are graphs of relations between an absolute water content in the ambience and an output current of the high voltage source.
Figure 7B:
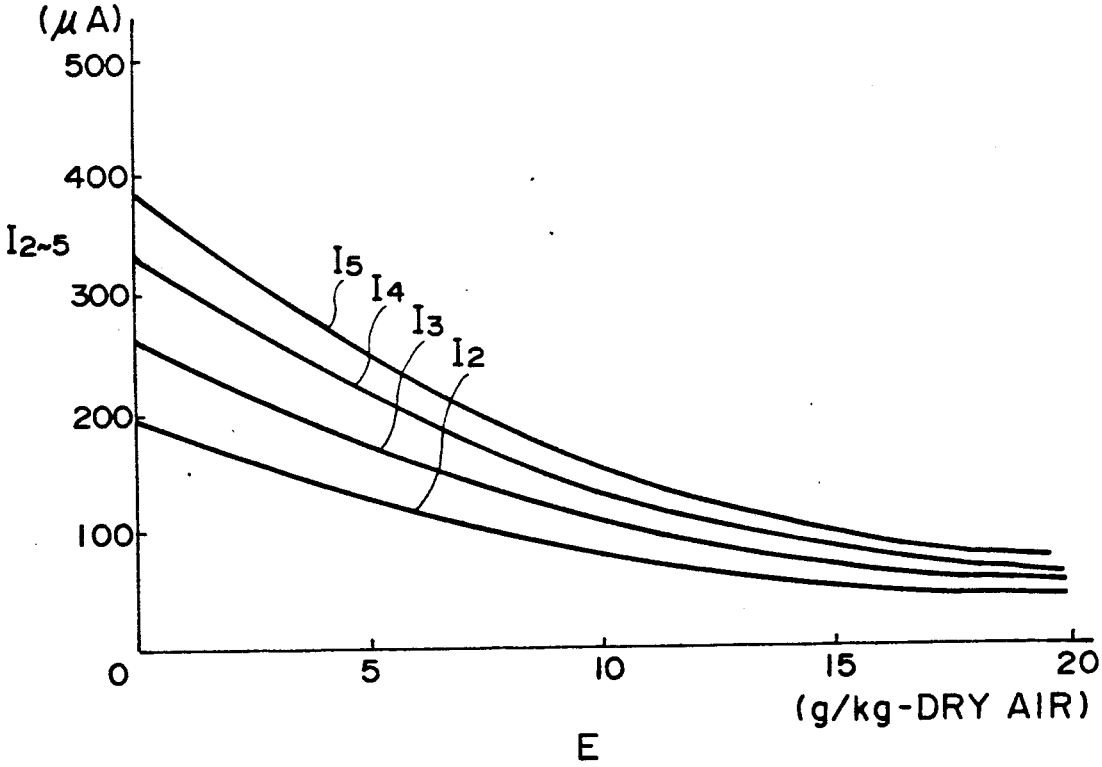
Figure 7C:
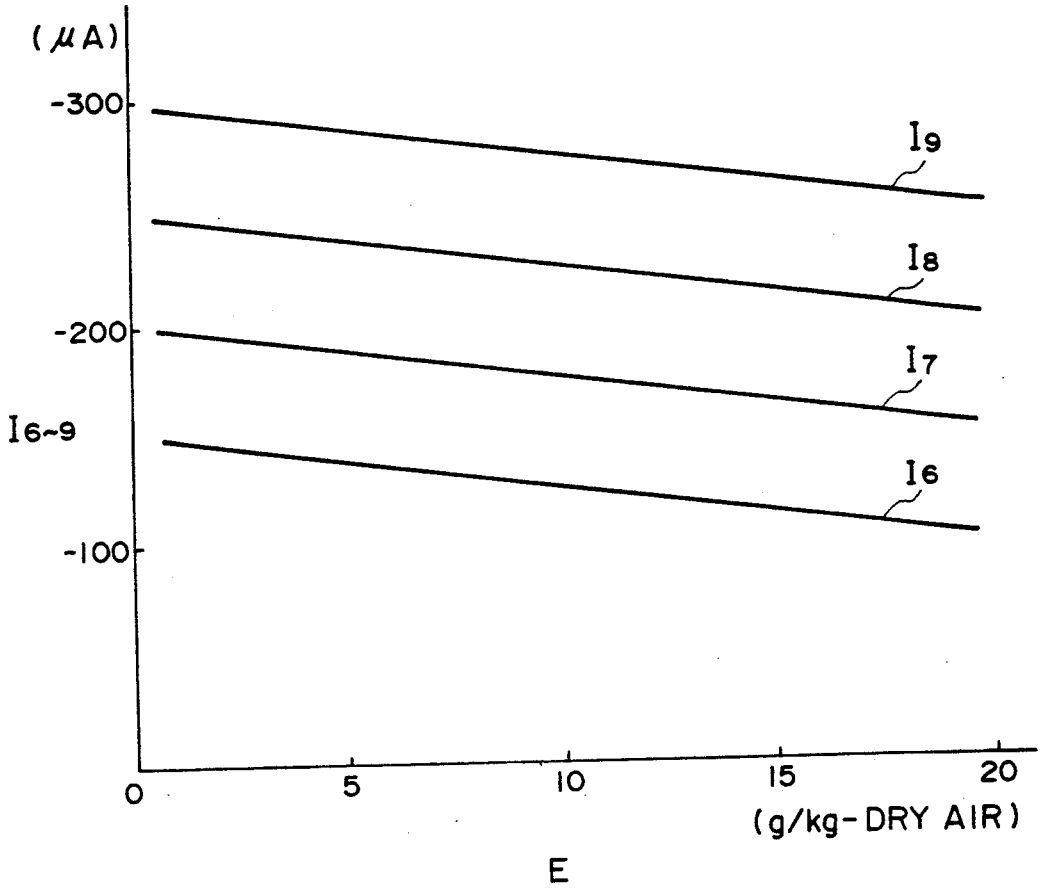

As shown in FIG. 6, the ambience sensor means 27 starts to operate upon start of the copy operation. Immediately before the start of the corona discharge, the high voltage control means 22 reads the ambience data (temperature and humidity). The dischargers are supplied with the electric currents in accordance with the data, more particularly, in accordance with the control shown in FIGS. 7A, 7B and 7C for example, upon which the dischargers effect the discharging action. FIG. 7A shows the relation between the absolute water content E in the ambience and the output current I1 of the high voltage source 17; FIG. 7B shows the relation between the absolute water content E in the ambience and the output currents I2–I5 during toner image transfer operation for the first–fourth toner images by the high voltage source 18; and FIG. 7C shows the relation between the absolute water content E of the ambience and output currents I6–I9 of the high voltage source 19 when the formed images are in the first–fourth color. The following Table 1 shows the relation between the absolute water content E and the output currents I1–I9. The attraction charger 12 and the transfer charger 13 are constant-current-controlled, and I1–I5 are the constant currents Only a DC voltage applied to the inside discharger 14 is constant-current-controlled, and I6–I9 are the constant current. As will be understood from FIGS. 7B and 7C, the outputs of the transfer charger increase with the number of transfer operations.

TABLE 1

| | | Relations | Correcting equations |
|---|---|---|---|
| Attraction charger | | $I_1 = (E - 20)^2 + 100$ | $I_1 = (E - \alpha_1 - 20)^2 + 100 + \beta_1$ |
| Transfer charger | 1st color | $I_2 = 0.4\,(E - 20)^2 + 40$ | $I_2 = 0.4\,(E - \alpha_2 - 20)^2 + 40 + \beta_2$ |
| | 2nd color | $I_3 = 0.55\,(E - 20)^2 + 50$ | $I_3 = 0.55\,(E - \alpha_3 - 20)^2 + 50 + \beta_3$ |
| | 3rd color | $I_4 = 0.7\,(E - 20)^2 + 60$ | $I_4 = 0.7\,(E - \alpha_4 - 20)^2 + 60 + \beta_4$ |
| | 4th color | $I_5 = 0.8\,(E - 20)^2 + 70$ | $I_5 = 0.8\,(E - \alpha_5 - 20)^2 + 70 + \beta_5$ |
| Monocolor | Inside | $I_6 = 2.5\,E - 150$ | $I_6 = 2.5\,(E - \alpha_6) - 150 + \beta_6$ |
| Two colors | discharger | $I_7 = 2.5\,E - 200$ | $I_7 = 2.5\,(E - \alpha_7) - 200 + \beta_7$ |
| Three colors | | $I_8 = 2.5\,E - 250$ | $I_8 = 2.5\,(E - \alpha_8) - 250 + \beta_8$ |
| Four colors | | $I_9 = 2.5\,E - 300$ | $I_9 = 2.5\,(E - \alpha_9) - 300 + \beta_9$ |

Figure 2:
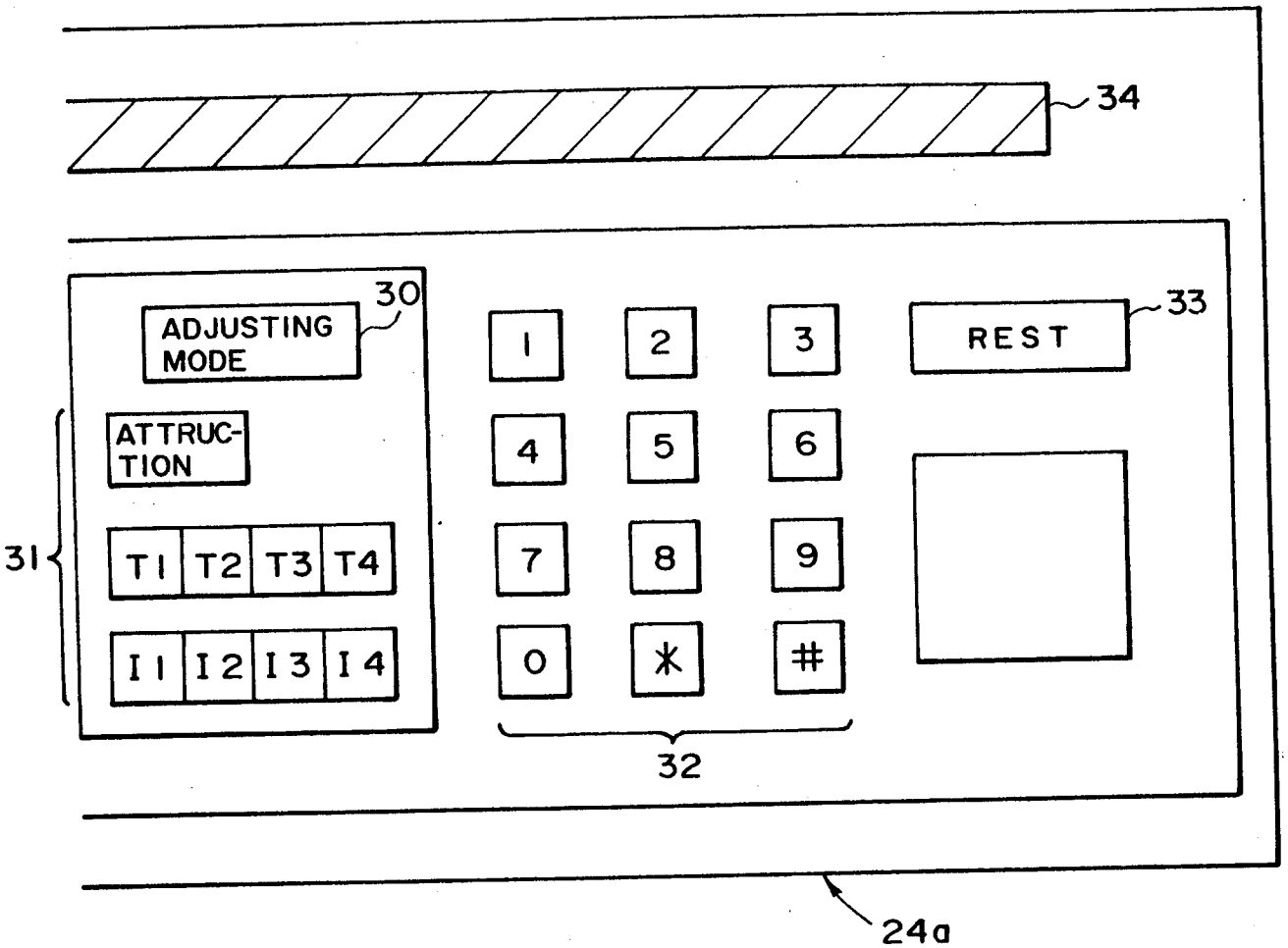
FIG. 2 is a top plan view of a control panel including adjusting means in the embodiment.

Adjusting means (correcting means) 24 is directly connected with the setting table shown in FIGS. 7A, 7B and 7C in the high voltage control means 22. When the operator manipulates the adjusting means 24, the setting table can be changed. The adjusting means 24 is provided with an operation panel 24a shown in FIG. 2 for entering signals for the correction (input means) The operation panel 24a is provided with an adjusting mode setting selector switch 30, adjusting item selector switch 31, ten keys 32 for the operation, a resetting key 33 and a liquid crystal display 34.

As will be understood from the above Table 1, the output current I1 of the high voltage source 17 controlled by the high voltage control means 22, the output currents I2–I5 of the high voltage source 18 during the toner image transfer operations for the first–fourth colors, and the output currents I6–I9 of the high voltage source 19 when the formed images are in the first–fourth colors, are obtained as functions of the absolute water content E detected by the ambience sensor 23. In addition, in accordance with the correcting equations, the functions can be changed.

The variables $\alpha 1$–$\alpha 9$ and $\beta 1$–$\beta 9$ in the correcting equations are properly changed by the operator by manipulating the operation panel 24a.

In this embodiment, the AC voltage applied to the inside discharger 14, the outside discharger 15 and the separation charger 16 are constant-voltage-controlled so that the peak-to-peak voltages (the differences between the maximum voltage and the minimum voltage) are 12KV, 8KV and 10KV in the form of sine waves. Namely, only the DC voltage component applied to the inside discharger 14 is constant-current-controlled. The waveform of the AC voltage is not limited to the sine wave, but may be rectangular or triangular waves.

Figure 3:
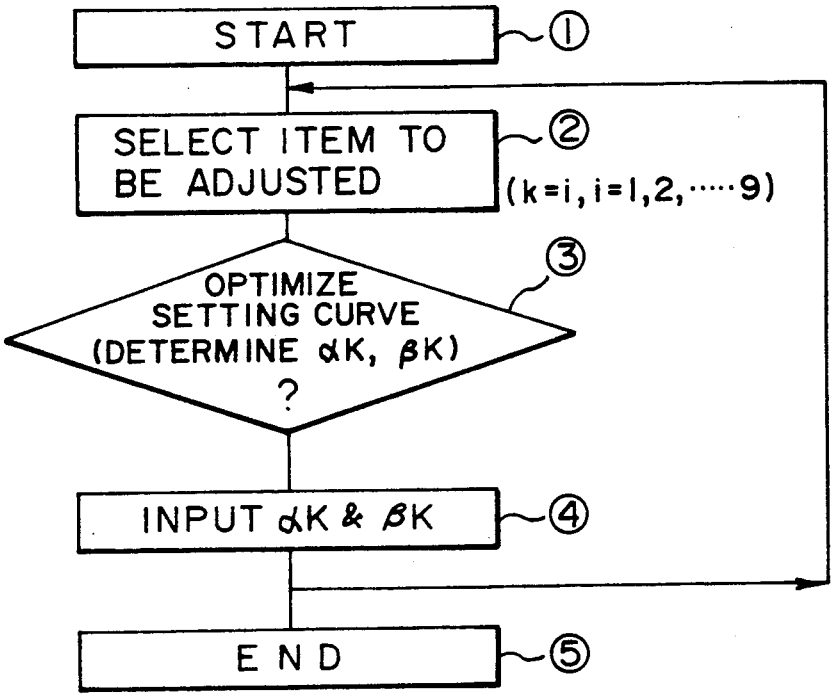
FIG. 3 is a flow chart illustrating sequential operation of the adjustment in the embodiment.

Referring to FIG. 3, the description will be made as to the adjustment setting mode for changing the setting table. When the operator depresses the mode selector switch 30, the set adjusting mode is selected (step 1). At this time, the liquid crystal display 34 displays the selection of the set adjusting mode. Then, the operator depresses the set item selector switch 31 (step 2). When, for example, the operator wants to the output current I1 of the attraction charger 12, the switch "ATTRACTION" in the adjustment item selector switch 31 is depressed. By doing so, the apparatus is prepared for accepting adjustment of the variables 11 and 11 in the correcting equation in Table 1. Similarly, when the output currents I2–I9 are desired to be adjusted, the switches "T1", "T2", "T3" and "T4", and "I1", "I2", "I3"and "I4".

In this manner, the operator sets the variables $\alpha$ and $\beta$ to optimum levels (steps 3). The selection of the optimum levels are empirically carried out. However, the examples of basic principles are as follows. Under a low humidity ambience, for example, the resistance of the dielectric sheet 2a is larger than under the normal ambience, so that the attraction force of the transfer material to the dielectric sheet 2a is too weak to properly attract the transfer material. Then, in order to increase the output current of the attraction charger 12, the variables $\alpha$ and $\beta$ are positive and large. On the contrary, under the high humidity ambience, the resistance of the dielectric sheet 2a is smaller than under the normal humidity ambience, and therefore, the attraction force is so strong that the transfer material is creased. In this case, in order to reduce the output current, the variables $\alpha$ and $\beta$ are negative and large. The selected variables $\alpha$ and $\beta$ are entered by ten keys 32 (step 4).

In this manner, the setting table is adjusted for one item, and the operation returns to step 2, where another adjustment item is selected, and the operations similar to the above are repeated. In this manner, the setting tables for the output currents of the transfer charger 13 and the discharger 14 are sequentially changed. The change or modification of the setting tables are empirically performed in the above, but this is not limiting, and a measuring device for the modification may be used. After the sequential set adjusting operations are performed, the resetting key 33 is depressed, upon which the copying mode is restored (step 5).

According to this embodiment, the setting functions regarding the output currents of the high voltage sources 17, 18 and 19 can be changed, and therefore, the output currents may be made optimum, accommodating the differences in the impedances of various parts and the time changes of the impedances. Therefore, the amounts of the electric charge contributable to the image transfer operation from the dischargers can be maintained optimum. Accordingly, the desirable image transfer operation can be performed, and high quality images can be produced.

In the foregoing embodiments, the number of variables adjusted by the adjusting means 24 is two ($\alpha$, $\beta$) as shown in Table 1. Only either one of them may be variable.

For example, only the variable $\alpha$ is adjustable (Table 1), it is possible to correct the absolute water content E. Particularly when the variations are large in the ambience sensor, namely, the temperature and humidity sensors in the individual image forming machines, but the variation is not so large in the chargers controlled on the basis of the outputs of the sensors, the variable $\alpha$ may be properly adjusted for the individual machines. In this case, in FIGS. 7A, 7B and 7C, the functions are changeable only in the direction of the axis E.

The structure wherein only the variable $\beta$ in Table 1 is adjustable is applicable to the case in which the variations in the temperature and humidity sensors in the individual machines is very small, but the variations in the chargers controlled on the basis of the detections thereby is particularly large (variations in the configurations of the chargers). In this case, the functions are changeable only in the direction of the axis I, in FIGS. 7A, 7B and 7C.

However, it is desirable that two variables $\alpha$ and $\beta$ are adjustable. This is because the set current is generally steep under the low humidity condition, but is not steep under the high humidity condition, and therefore, the effects of the change of the variables are different if the humidity conditions are different.

In the foregoing embodiment, the setting table is changed by simply translating the setting table curves with respect to the absolute water content and the output current. However, by changing the inclination of the setting table curves, the output currents can be further correctly controlled. The following Table 2 shows an example of such correcting equations.

TABLE 2

| | | Relations | Correcting equations |
|---|---|---|---|
| Attraction charger | | $I_1 = (E - 20)^2 + 100$ | $I_1 = \gamma_1 (E - \alpha_1 - 20)^2 + 100 + \beta_1$ |
| Transfer charger | 1st color | $I_2 = 0.4 (E - 20)^2 + 40$ | $I_2 = 0.4 \gamma_2 (E - \alpha_2 - 20)^2 + 40 + \beta_2$ |
| | 2nd color | $I_3 = 0.55 (E - 20)^2 + 50$ | $I_3 = 0.55 \gamma_3 (E - \alpha_3 - 20)^2 + 50 + \beta_3$ |
| | 3rd color | $I_4 = 0.7 (E - 20)^2 + 60$ | $I_4 = 0.7 \gamma_4 (E - \alpha_4 - 20)^2 + 60 + \beta_4$ |
| | 4th color | $I_5 = 0.8 (E - 20)^2 + 70$ | $I_5 = 0.8 \gamma_5 (E - \alpha_5 - 20)^2 + 70 + \beta_5$ |
| Monocolor | Inside | $I_6 = 2.5 E - 150$ | $I_6 = 2.5 \gamma_6 E - 150 + \beta_6$ |
| Two colors | discharger | $I_7 = 2.5 E - 200$ | $I_7 = 2.5 \gamma_7 E = 200 + \beta_7$ |
| Three colors | | $I_8 = 2.5 E - 250$ | $I_8 = 2.5 \gamma_8 E - 250 + \beta_8$ |
| Four colors | | $I_9 = 2.5 E - 300$ | $I_9 = 2.5 \gamma_9 E - 300 + \beta_9$ |

In the correcting equations for the attraction charger and the transfer charger in Table 2, there are three correcting variables.

Figure 4:
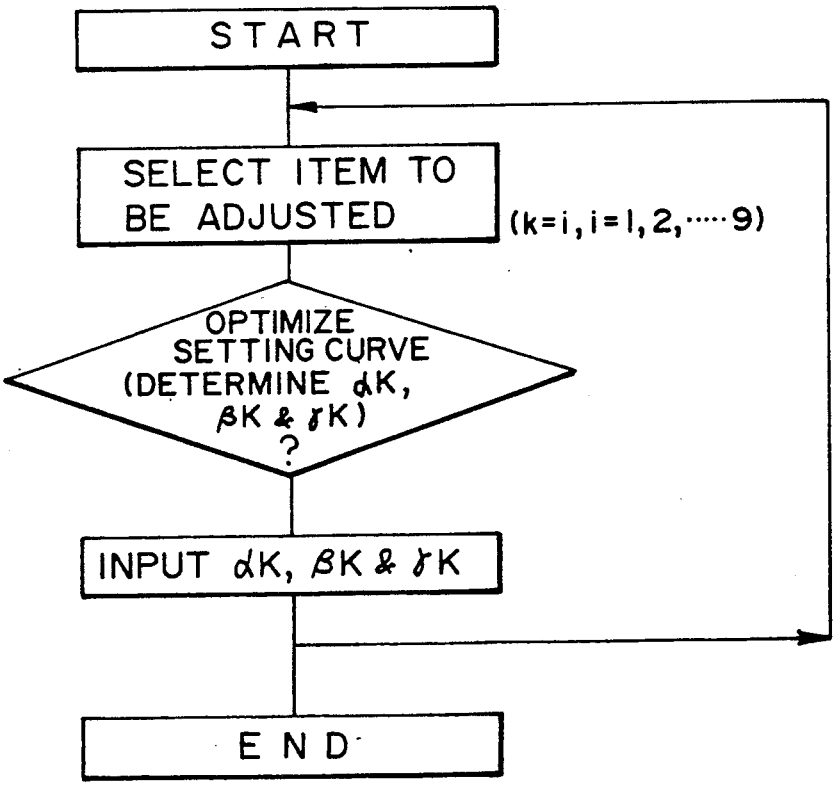
FIG. 4 is a flow chart illustrating the sequential operation in the adjustment when three items are to be corrected.
Figure 5:
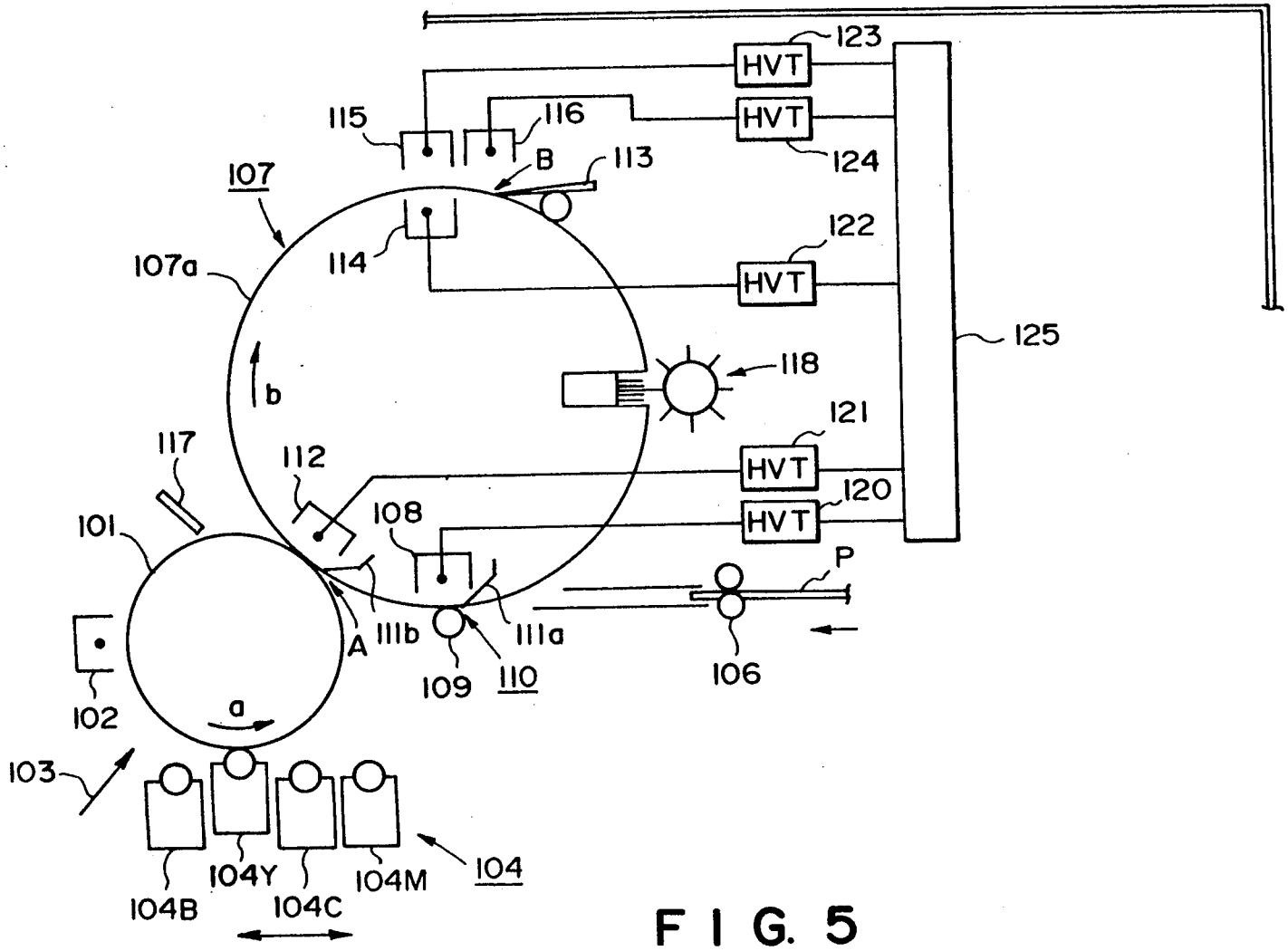
FIG. 5 is a sectional view of a part of a conventional image forming apparatus.

FIG. 4 is a flow chart illustrating the adjusting operation for the setting table using such correcting equations. The steps of the adjusting operations are the same as the embodiment of FIG. 3. However, the order of adjusting the variables $\alpha$, $\beta$ and $\gamma$ is preferably such that the variable $\gamma$ is first determined since it has greater influence to the property. When the $\gamma$ is to be determined, it is increased with increase in the difference of the developments between under the high humidity ambience and under the low humidity ambience.

It is a possible alternative that only the variables $\beta$ and $\gamma$ are corrected as in the correcting equation for the inside discharger in Table 2, or that only the variable $\gamma$ is corrected, or that the variables $\gamma$ and $\alpha$ are corrected, the latter two cases not being shown in the Table.

Generally, when the output current I is an n-order function of the absolute water content E in the ambience, the number of correcting variables in the correcting equation is enough if it is $n+1$. With the increase of the number of correcting variables, the accuracy of the adjustment is increased, but the adjusting operation becomes more complicated, and therefore, it is not desirable that the number of correcting variables is larger than $n+1$.

In the foregoing embodiment, the ambience sensor detects both of the temperature and humidity. It is a possible alternative that either one of them is detected. In the foregoing embodiment, the output current of the charger is controlled, as shown in the Table, but the output voltage rather than the output current may be controlled.

As described in the foregoing, according to the present invention, the correcting means is provided to adjust the setting function determining the output current or voltage of the charger or discharger on the basis of the output of the detecting means. Therefore, optimum current or voltage may be produced from the high voltage source at all times in accordance with the property changes due to the impedance changes with time, which is in turn attributable to the differences in the ambient conditions under which individual machines are installed, the differences in the individual machines, the differences in the impedances in the machines, the deterioration of the confining member for confining the current by the charger or the like.

When the charger is the image transfer charger, local void of the transferred image may be prevented, so that good image transfer operation is possible, and therefore, a high quality image can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:
a movable image bearing member;
image forming means for forming an image on said image bearing member;
transfer charging means for transferring an image from said image bearing member onto an image receiving material at an image transfer position;
detecting means for detecting an ambient condition of said apparatus;
control means for controlling an output of said transfer charging means in accordance with an output of said detecting means, the output of said transfer charging means being a curved function of the output of said detecting means; and
correcting means for correcting the curved function by translation shift.

2. An apparatus according to claim 1, wherein said correcting means shifts the function on coordinates along a X axis direction representing the output of said detecting means, wherein a Y axis represents the output of said transfer charging means.

3. An apparatus according to claim 1, wherein said correcting means shifts the function on coordinates along a Y axis direction representing the output of said transfer charging means, wherein an X axis represents the output of said detecting means.

4. An apparatus according to claim 1, 2 or 3, wherein said correcting means further changes an inclination of the function.

5. An apparatus according to claim 1, wherein said correcting means shifts the function on coordinates both along X axis and Y axis directions wherein the X and Y axes represent the output of said detecting means and the output of said transfer charging means, respectively.

6. An apparatus according to claim 1, wherein said correcting means corrects the output of said detecting means, a result of said function and an inclination of the output of said detecting means relative to the result.

7. An apparatus according to claim 1, wherein said detecting means is inside said apparatus.

8. An apparatus according to claim 1 or 7, wherein said detecting means detects a temperature.

9. An apparatus according to claim 1 or 7, wherein said detecting means detects a humidity.

10. An apparatus according to claim 1 or 7, wherein said detecting means detects a temperature and a humidity.

11. An apparatus according to claim 1, wherein the output of said transfer charging means is an output current or an output voltage thereof.

12. An apparatus according to claim 1, wherein said correcting means includes input means for entering a signal for correcting the function.

13. An apparatus according to claim 1, wherein said image receiving material is paper.

14. An apparatus according to claim 1, wherein said transfer charging means includes a corona discharger.

15. An image forming apparatus, comprising:
a movable image bearing member;
image forming means for forming an image on said image bearing member;
transfer means for transferring an image from said image bearing member to an image receiving material at a transfer position;
carrying means for carrying the image receiving material to the transfer position, wherein the image is transferred while the image receiving material is being supported on said carrying means;
discharging means actable on said carrying means;
detecting means for detecting an ambient condition of said apparatus;
control means for controlling an output of said discharging means in accordance with an output of said detecting means, the output of said discharging means being a function of the output of said detecting means; correcting means for correcting the function by translational shift.

16. An apparatus according to claim 15, wherein said correcting means shifts the function on coordinates along an X axis direction representing the output of said detecting means, wherein a Y axis represents the output of said discharging means.

17. An apparatus according to claim 15, wherein said correcting means shifts the function on coordinates along a Y axis direction representing the output of said discharging means, wherein an X axis represents the output of said detecting means.

18. An apparatus according to claim 15, 16 or 17, wherein said correcting means further change an inclination of the function.

19. An apparatus according to claim 15, wherein said correcting means shifts the function on coordinates both along X axis and Y axis directions wherein the X and Y axes represent the output of said detecting means and the output of said discharging means, respectively.

20. An apparatus according to claim 19, wherein said correcting means further changes an inclination of the function.

21. An apparatus according to claim 15, wherein said detecting means is inside said apparatus.

22. An apparatus according to claim 15 or 21, wherein said detecting means detects a temperature.

23. An apparatus according to claim 15 or 21, wherein said detecting means detects a humidity.

24. An apparatus according to claim 15 or 21, wherein said detecting means detects a temperature and a humidity.

25. An apparatus according to claim 15, wherein the output of said discharging means is an output current or an output voltage of said discharging means.

26. An apparatus according to claim 15, wherein said correcting means includes input means for entering a signal for correcting the function.

27. An apparatus according to claim 15, wherein said image receiving material is paper.

28. An apparatus according to claim 15, wherein said discharging means functions as said transfer means.

29. An apparatus according to claim 15, wherein said discharging means is effective to electrostatically attracting the image receiving material on said carrying means.

30. An apparatus according to claim 15, wherein said discharging means functions to electrically discharge the image receiving material on said carrying means, after the image is transferred by said transfer means.

31. An apparatus according to claim 15, wherein said discharging means functions to electrically discharge the image receiving material when the image receiving material is separated from said carrying means.

32. An apparatus according to claim 15, wherein said carrying means includes a dielectric sheet for carrying the image receiving material on its surface.

33. An apparatus according to claim 15 or 28, wherein said image forming means forms a plurality of different color images on said image bearing member, and the images are transferred onto the same image receiving material carried on said carrying means.

34. An apparatus according to claim 30, wherein said image forming means forms a plurality of different color images on said image bearing member, and the images are transferred onto the same image receiving material carried on said carrying means.

35. An apparatus according to claim 33, wherein a full-color image is formed on the image receiving material after the images are transferred onto it.

36. An apparatus according to claim 15, wherein said carrying means is movable along an endless path.

37. An apparatus according to claim 33, wherein an output of said transfer means increases with number of transfer operations for the different colors.

38. An apparatus according to claim 34, wherein an output of said transfer means increases with number of transfer operations for the different colors.

39. An apparatus according to claim 28, 29, 30 or 31, wherein said discharging means includes a corona discharger.

40. An apparatus according to claim 12 or 26, wherein said input means is manually operable.

41. An image forming apparatus, comprising:

a movable image bearing member; p1 image forming means for forming an image on said image bearing member;

transfer means for transferring an image from said image bearing member to an image receiving material at a transfer position;

carrying means for carrying the image receiving material to the transfer position, wherein the image is transferred while the image receiving material is being supported on said carrying means;

a plurality of discharging means actable on said carrying means;

detecting means for detecting an ambient condition of said apparatus;

control means for controlling an output of said discharging means, wherein the output of said discharging means is a function of the output of said detecting means; and correcting means for correcting the functions of said plural discharging means, independently from each other.

42. An apparatus according to claim 41, wherein the output of said discharging means is a curved function of said detecting means, and said correcting means corrects the function by translational shift.

43. An apparatus according to claim 42, wherein said correcting means shifts the function on coordinates both along X axis and Y axis directions where in the X and Y axes represent the output of said detecting means and the output of said discharging means, respectively.

44. An apparatus according to claim 43, wherein said correcting means further changes an inclination of the function.

45. An apparatus according to claim 41, wherein said detecting means detect a temperature.

46. An apparatus according to claim 41, wherein said detecting means detects a humidity.

47. An apparatus according to claim 41, wherein said detecting means detects a temperature and a humidity.

48. An apparatus according to claim 41, wherein the output of said discharging means is an output current or an output voltage of said discharging means.

49. An apparatus according to claim 41, wherein said correcting means includes input means for entering a signal for correcting the function.

50. An apparatus according to claim 41, wherein said discharging means functions as said transfer means.

51. An apparatus according to claim 41, wherein said discharging means is effective to electrostatically attracting the image receiving material on said carrying means.

52. An apparatus according to claim 41, wherein said discharging means function to electrically discharge the image receiving material on said carrying means, after the image is transferred by said transfer means.

53. An apparatus according to claim 41, wherein said discharging means function to electrically discharge the image receiving material when the image receiving material is separated from said carrying means.

54. An apparatus according to claim 41, wherein said carrying means includes a dielectric sheet for carrying the image receiving material on its surface.

55. An apparatus according to claim 41, wherein said image forming means forms a plurality of different color images on said image bearing member, and the images are transferred onto the same image receiving material carried on said carrying means.

56. An apparatus according to claim 55, wherein a full color image is formed on the image receiving material after the images are transferred onto it.

57. An apparatus according to claim 49, wherein said input means is manually operable.

* * * * *

UNITED STATES PATENT AND TRADEMARK OFFICE

CERTIFICATE OF CORRECTION

PATENT NO. : 5,128,717

DATED : July 7, 1992

INVENTOR(S) : UCHIKAWA, et al.

It is certified that error appears in the above-identified patent and that said Letters Patent is hereby corrected as shown below:

IN THE DRAWINGS

FIGURE 1

"AMBIZNCE" should read --AMBIENCE--.

FIGURE 2

"ATTRUC-" should read --ATTRAC---.

FIGURE 6

"ATRACTION" should read --ATTRACTION--.

COLUMN 2

Line 30, "sources 120-24" should read --sources 120-124--.

UNITED STATES PATENT AND TRADEMARK OFFICE

CERTIFICATE OF CORRECTION

PATENT NO. : 5,128,717

DATED : July 7, 1992

INVENTOR(S) : UCHIKAWA, et al.

It is certified that error appears in the above-identified patent and that said Letters Patent is hereby corrected as shown below:

COLUMN 7

Line 27, "variables 11 and 11" should read --variables α1 and β1--.

COLUMN 10

Line 7, "a" should read --an--.
Line 65, "means; connecting means" should read --means; and correcting means--.

COLUMN 12

Line 13, "member; p1 image forming" should read --member; image forming--.
Line 41, "where in" should read --wherein--.
Line 48, "detect" should read --detects--.
Line 66, "function" should read --functions--.

COLUMN 13

Line 2, "function" should read --functions--.

UNITED STATES PATENT AND TRADEMARK OFFICE

CERTIFICATE OF CORRECTION

PATENT NO. : 5,128,717
DATED : July 7, 1992
INVENTOR(S) : Uchikawa, et. al.

It is certified that error appears in the above-indentified patent and that said Letters Patent is hereby corrected as shown below:

Column 13

Line 2, "function" should read --functions--.

Signed and Sealed this

Nineteenth Day of October, 1993

Bruce Lehman

*Attest:*

BRUCE LEHMAN

*Attesting Officer*

*Commissioner of Patents and Trademarks*